US006732870B2

(12) United States Patent
Johansson

(10) Patent No.: US 6,732,870 B2
(45) Date of Patent: May 11, 2004

(54) STORAGE SYSTEM HAVING AT LEAST ONE STORAGE SHELF WHICH IS INFINITELY ADJUSTABLE RELATIVE TO AN UPRIGHT MEMBER

(75) Inventor: Christer Johansson, Knivsta (SE)

(73) Assignee: CLL Connectors & Cables AB, Knivsta (SE)

( * ) Notice: Subject to any disclaimer, the term of this patent is extended or adjusted under 35 U.S.C. 154(b) by 0 days.

(21) Appl. No.: 10/363,062

(22) PCT Filed: Aug. 30, 2001

(86) PCT No.: PCT/SE01/01843

§ 371 (c)(1),
(2), (4) Date: Feb. 28, 2003

(87) PCT Pub. No.: WO02/17749

PCT Pub. Date: Mar. 7, 2002

(65) Prior Publication Data

US 2003/0183736 A1 Oct. 2, 2003

(30) Foreign Application Priority Data

Sep. 1, 2000 (SE) ..... 0003090

(51) Int. Cl.[7] ..... A47B 43/00
(52) U.S. Cl. ..... 211/187; 248/246; 108/110
(58) Field of Search ..... 248/239, 247, 248/244, 222.51, 222.14, 125.1, 246; 211/187, 193, 205; 108/108, 109, 110

(56) References Cited

U.S. PATENT DOCUMENTS

| | | | | | |
|---|---|---|---|---|---|
| 1,041,264 | A | * | 10/1912 | Freud | 248/245 |
| 2,703,692 | A | | 3/1955 | Felix | |
| 3,462,110 | A | | 8/1969 | Cheslock | |
| 3,664,627 | A | * | 5/1972 | Sykes et al. | 248/246 |
| 3,848,844 | A | * | 11/1974 | Barrett | 248/245 |
| 4,103,855 | A | * | 8/1978 | Grosse | 248/246 |
| 4,156,515 | A | * | 5/1979 | Mochly | 248/246 |
| 4,223,863 | A | * | 9/1980 | Birman | 248/246 |
| 4,274,614 | A | | 6/1981 | Worrallo | |
| 4,299,368 | A | * | 11/1981 | Winkler | 248/246 |
| 4,421,289 | A | | 12/1983 | Sturm | |
| 4,538,784 | A | * | 9/1985 | O'Flanagan | 248/244 |
| 5,044,508 | A | * | 9/1991 | Walter | 211/207 |
| 5,170,898 | A | * | 12/1992 | Katz et al. | 211/193 |
| 5,388,796 | A | * | 2/1995 | Sullivan | 248/246 |
| 5,484,068 | A | * | 1/1996 | Huang | 211/193 |
| 5,941,399 | A | * | 8/1999 | Wang | 211/187 |
| 6,547,088 | B1 | * | 4/2003 | Wang | 211/187 |
| 6,591,996 | B1 | * | 7/2003 | Wu | 211/90.02 |

FOREIGN PATENT DOCUMENTS

| | | |
|---|---|---|
| SE | 306816 | 12/1968 |

* cited by examiner

*Primary Examiner*—Leslie A. Braun
*Assistant Examiner*—Kofi Schullerbrandt
(74) *Attorney, Agent, or Firm*—Young & Thompson

(57) ABSTRACT

A storage system, having one or multiple shelves infinitely adjustable on an upright member. The upright member is a singular support structure with at least three parallel grooves running longitudinally below a front face of the vertical support, the grooves having a continuous sectional profile and each groove opening in the front face through a channel. The shelf or shelves are formed on a back side with at least three tongues integrally formed in the shelf and adjoining the back side through a neck portion. The tongues are insertable in the grooves while the neck portions occupy the channels. The neck portions are curved so that the tongues project upwards from the shelf upper surface at a slanting angle, such that the tongues are frictionally arrested in the grooves when the shelf is pivoted to bring the tongues to a tilted position in the grooves.

9 Claims, 3 Drawing Sheets

STORAGE SYSTEM HAVING AT LEAST ONE STORAGE SHELF WHICH IS INFINITELY ADJUSTABLE RELATIVE TO AN UPRIGHT MEMBER

TECHNICAL FIELD

This invention relates to a storage system, having in combination one or several shelves that are infinitely adjustable relative to an upright member according to the preamble of claim 1.

TECHNICAL BACKGROUND AND PRIOR ART

Storage systems are known with shelves supported on two or more brackets that are infinitely adjustable on separate upright members that run in parallel on a wall, or from a floor base, e.g. Examples of such known systems are found in U.S. Pat. No. 4,170,335 and FR 1,197,532. However, these bracket supported shelf systems do not meet the need for a storage system of maximum flexibility and minimum complexity. Drawbacks connected with the known bracket shelf systems are the number of elements involved when adapting the system for another use, and a building height due to the brackets that occupies space in the system. The need for a novel storage system wherein these drawbacks are omitted is significantly evident in assembly lines in the electronic industry, e.g., where it is desired to have access to different tools and a large number of various mounting details and materials.

SUMMARY OF THE INVENTION

An object of the, present invention is therefore to provide a storage system of maximum flexibility and with minimum complexity for the user.

The object is met in the storage system defined in appended claim 1. Embodiments of the novel storage system are defined in the subordinated claims.

Briefly, the invention suggests a storage system, having in combination one singular shelf or multiple shelves infinitely adjustable on an upright member. The upright member is a singular support structure with at least three parallel grooves running longitudinally below a front face of the vertical support, the grooves having a continuous sectional profile and each groove opening in the front face through a channel. The shelf or shelves are formed on a back side with at least three tongues, the tongues being integrally formed in the shelf and adjoining the back side through a neck portion. One of the tongues has a through hole for a bolt that engages an inner wall surface of one of said grooves for securing the shelf in a bearing position The planar shape of the tongues are adapted to the sectional profile of the grooves, and the length and width of the neck portions are adapted to the sectional length and width of the groove channels, respectively, such that the neck portions occupy the channels while the tongues are inserted in the grooves. The neck portions are curved so that the tongues project upwards from the shelf top surface at a slanting angle, such that the tongues are frictionally arrested in the grooves when the shelf is pivoted to bring the tongues to a tilted position relative to the grooves. In the arrested position, the back side of the shelf has a load bearing contact against the front face of the vertical support.

Preferably, the sectional profile of the grooves and the planar shape of the tongues are circular. Advantageous embodiments of the storage system may include a self supported vertical column of pentagonal section, rising from a floor or table base. The vertical support may be rotatable, and may advantageously comprise a horizontal slit through the front face for insertion of the tongues laterally into the grooves.

SHORT DESCRIPTION OF THE DRAWINGS

The storage system will be further described below with reference to the attached drawings, wherein FIG. 1 is a sectional view of a pentagonal vertical support forming part of the system;

DETAILED DESCRIPTION OF THE INVENTION

Figure 3:
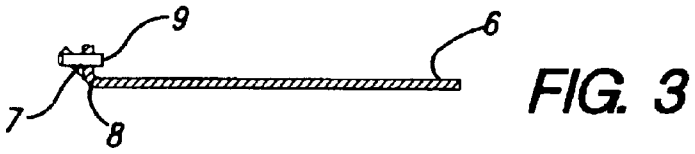
FIG. 3 is a sectional view of the shelf of FIG. 2, taken along the line III—III in FIG. 2.

The storage system of the present invention comprises in combination a vertical support and a self bearing shelf, directly supported in load bearing contact with a front face of the vertical support. The storage system is described with reference to FIGS. 1 and 6 of the drawings.

The vertical support 1 is an elongate element that may be attached to a wall or realized as a self supporting column 1, having one or several front faces 2. Each front face has three or more longitudinal grooves 3 with a continuous sectional profile, running in parallel below the surface of front face 2. The grooves 3 are opening in the front face through channels 4, respectively, the channels having a sectional length and a sectional width. The sectional width of the channel has less dimension than the greatest sectional width of the groove 3 in a horizontal plane. The sectional profile of groove 3 may be round, oval or cornered. Most preferred, the sectional profile of groove 3 is circular and opening in the front face by a channel having parallel walls 5, reaching from the front face 2 to the periphery of the groove section and defining the length of the channel 4 in the horizontal plane.

The vertical support 1 preferably is an extruded element made from aluminum or other metal. In a preferred embodiment the vertical support is a self supported, multiple faced column, e.g. a pentagonal column, rising from a base (not shown) and rotatable about its longitudinal axis from a floor or table surface, etc. Another preferred embodiment foresees, that a vertical support of planar configuration is arranged to be attached to a standing element such as a building wall (not shown in the drawings). Alternatively, the vertical support may be clamped to rise from the edge of a table top, or equivalent.

Figure 2:
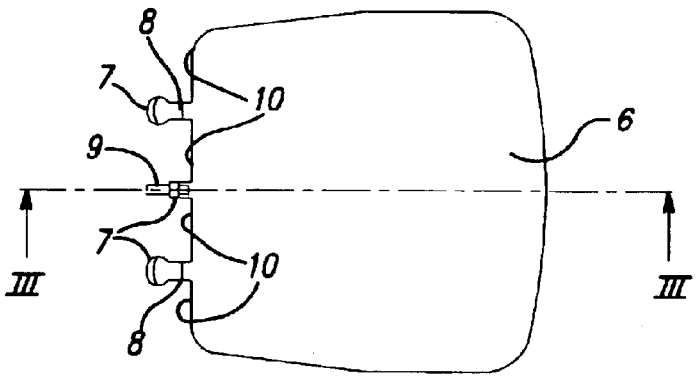
FIG. 2 is a planar view of a shelf forming part of the system.

FIG. 2 is a plan view showing a shelf element 6, forming part of the storage system and shaped to engage directly with the vertical support described above for a step-less and infinite adjustment relative thereto.

The shelf 6 may have any desired planar layout for supporting articles horizontally or at a slanting angle. The shelf 6 may have a continuous top surface as illustrated in FIG. 2, or may be slotted or perforated for the storage of tools, assembly details, materials, etc., or be formed with apertures for receiving separate containers for needles, bolts, nuts, washers, etc.

Tongues 7 are integrally formed with the shelf 6 and arranged to project from a backside of the shelf, i.e. from the side of the shelf that is facing the front face 2 in load bearing contact when the shelf is attached to the vertical support. The tongues 7 have a planar shape that is adapted to the sectional profile of the grooves 3. More specifically, the planar layout of the tongues is dimensioned such that the tongues are free to slide longitudinally within the grooves when the tongues have a horizontal orientation, but are frictionally arrested by the internal wall of the grooves when the tongues are pivoted from the horizontal orientation. Preferably, the tongues 7 have a circular planar shape with a radius that is slightly smaller than the radius of the grooves 3. Naturally, all grooves on the vertical support need not have the same sectional profile or the same sectional width, and all tongues on the shelf need not have the same planar shape and dimension, as long as each tongue is shaped and dimensioned to cooperate with the associated groove.

The tongues 7 connect to the back side of the shelf through neck portions 8. The neck portions 8 have a width that is slightly smaller than the width of channels 4, and a length that is substantially equal to, or slightly greater than the length of the channels 4 or channel walls 5. With reference also to FIG. 3, the neck portions 8 are bent or curved in a vertical plane. More specifically, the neck portions are bent such, that the tongues 7 project upwards from the top plane of the shelf 6 to have an angular orientation relative to the shelf.

Each shelf 6 has at least three integrally formed tongues 7 adjoining the back side of the shelf via neck portions 8. One of the tongues 7 is formed with a through hole for receiving a bolt 9, which is tightened against the inner wall of the groove for fixation of the shelf in an operative, load bearing position on the vertical support. The tongue that is carrying the bolt 9 may be bent to a separate angular orientation relative to other tongues, and shaped to be accommodated in the channel when bolt 9 is tightened for fixation. Alternatively, the tongue that carries the bolt may have a separate angular position, and shaped substantially as other tongues to be accommodated within the groove when bolt 9 is tightened for fixation. Also, the bolt 9 may reach through the tongue at an angular relative orientation.

The shelf 6 preferably is formed from a material of greater hardness than the vertical support, such as steel or steel alloy. Production is non-complicated through a laser cutting or water cutting procedure, e.g., followed by a bending procedure applied to the neck portions. The thickness of material in shelf 6 is adequate and sufficient for producing a frictional engagement when the tongue is pivoted or tilted in the groove in order to bear against the inner wall of the groove.

Figure 5:
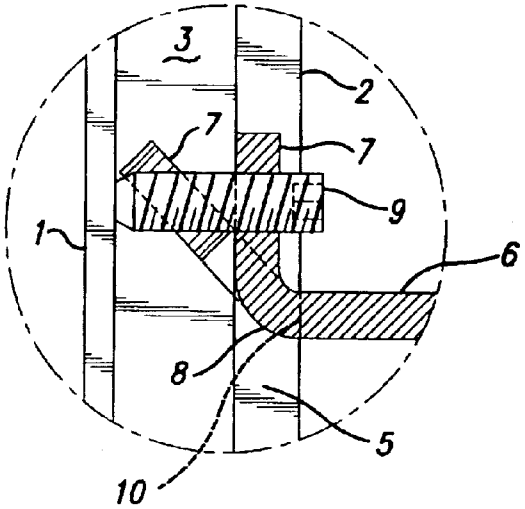
FIG. 5 is diagrammatic, detail view, showing the engagement between the shelf and the vertical support on a larger scale.
Figure 4:
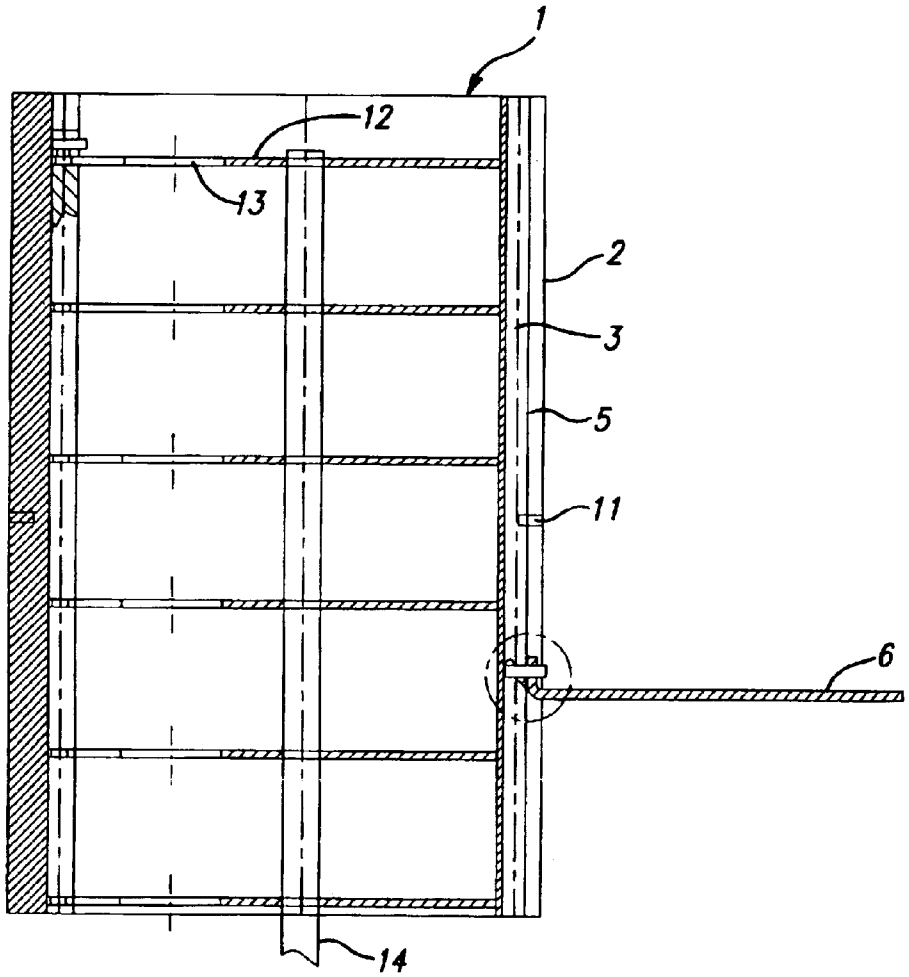
FIG. 4 is a longitudinal section showing the shelf in load bearing contact with the front face of the vertical support.

Referring now to FIGS. 4 and 5, which are longitudinal sections through the vertical support 1 showing a shelf 6 in frictional engagement for a substantially horizontal bearing position. It will be understood, that the curvature of the neck portions 8 is decisive for the orientation of the shelf in attached position on the vertical support.

As stated above, the tongues 7 are bent to project upwards from the top plane of shelf 6 through the curvature applied in neck portions 8. The tongues and neck portions are dimensioned to permit a step-less and infinite longitudinal displacement of the shelf, the tongues and neck portions sliding in the grooves and channels, respectively, when the tongues are pivoted for a horizontal or transverse orientation relative to the grooves. When the shelf is pivoted for an operative, horizontal or slightly slanting bearing position on the vertical support, the tongues are brought to frictionally engage the inner wall of the grooves, primarily with a portion of the upper, forward periphery of the tongues. For fixation, the bolt is tightened in order to prevent the shelf from unintentionally being pivoted to the sliding orientation. The materials of the vertical support and the shelf may advantageously be chosen to have a relative material hardness that permits the tongue periphery to make a slight deformation or indentation in the surface of the inner wall of groove 3.

In the operative position illustrated in FIGS. 4 and 5, the intermediate portions of the back side 10 of the shelf, i.e. the portions running between the neck portions 8, and if appropriate, also the portions on both sides of the outermost neck portions 8, are pivoted for a load bearing contact against the front face 2 of the vertical support. It will be understood that the back side has a rectangular orientation relative to the top plane of the shelf, if the operative position is horizontal as in the drawings. When a slanting orientation is desired for the shelf's operative position, the back side has an acute angular orientation relative to the top plane of the shelf 6. It will be appreciated that a weight load, applied to the shelf from above, will be converted to a stress load absorbed by the neck portions since the lowermost edge of the back side will then operate as a fulcrum.

FIG. 4 shows the bolt 9 in threaded engagement with the tongue 7, and the bolt end in bearing contact with the inner wall of groove 3. When tightened, the bolt 9 prevents an unintentional pivoting of the shelf 6 from the operative-position to a sliding orientation. The tongue is here shown to be formed and received for covering the corresponding space of the channel 4, substantially parallel with the front face 2. Alternatively, and not shown in the drawings, the tongue carrying the bolt may also be shaped substantially similar to the other tongues and arranged to extend within the groove.

Figure 1:
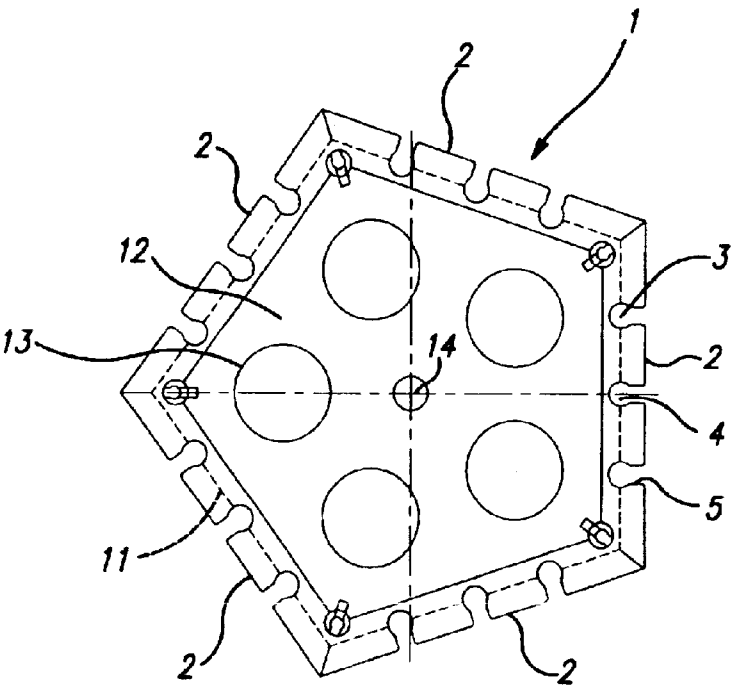

The detailed structure of the storage system may be varied without departing from the technical solution as defined in the appended claims. One such modification is illustrated in FIGS. 1 and 3, wherein a horizontal slot 11 in the front face 2 reaches the widest sectional portion of the grooves 3. The slot 11 has a horizontal depth sufficient to permit the tongues of an additional shelf to be inserted in the grooves without the need for rearrangement of other shelves, already supported on the vertical structure.

Figure 6:
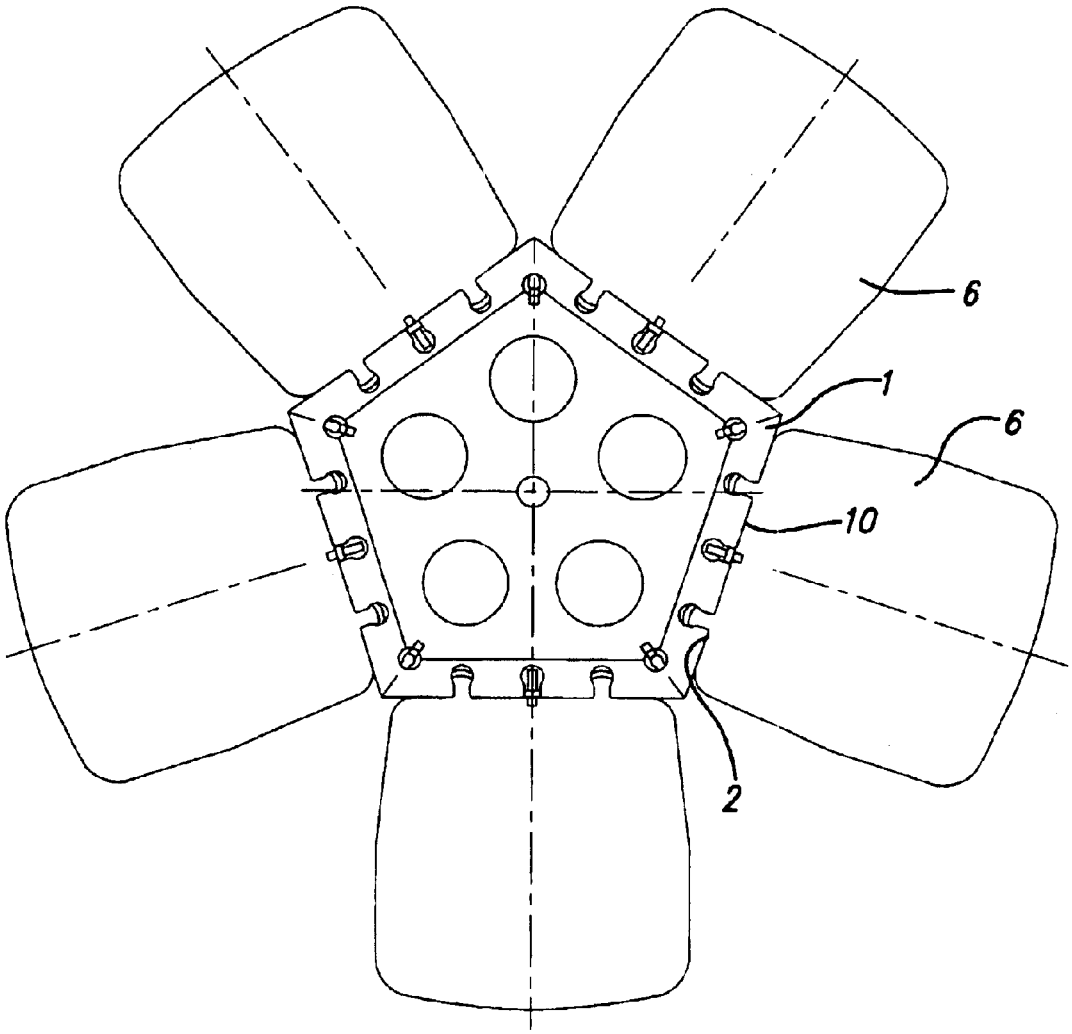
FIG. 6 shows an advantageous implementation of the storage system.

In this description, the vertical support 1 is illustrated by an embodiment wherein a hollow, pentagonal column is adapted for carrying shelves that extend radially outwards from all five sides of the column, as seen in FIG. 6. One or several horizontal shelves 12 are supported in the hollow center of the column and arranged with apertures 13 for receiving tools, containers or work material. A central through hole is formed for mounting the column to be rotated about an upright axis 14, rising from an optional floor/table base (not shown) or other fixation, as appropriate.

The storage system may be equipped and individually dressed for many varying storage needs, such as goods display, or for work site preparation in industrial assembly lines, for laboratory desks, etc., providing tools and working material within convenient reach of a user. The ability of infinite adjustment is enhanced by the lack of building height between shelves, providing unique possibilities and flexibility to adapt the storage system for specific needs and applications. In this aspect it is specifically appreciated, that the shelves are readily arranged to level with a bottom end of the vertical support, and substantially to level also with an upper end thereof. The versatility of the suggested storage system is made possible primarily due to the shelves being arranged for direct attachment to the support, without the need for additional supporting brackets and without complex production.

What is claimed is:

1. A storage system (1,6), having at least one storage shelf (6) which is infinitely adjustable relative to an upright member, the storage system comprising in combination:

a vertical support (1) having at least three parallel grooves (3) running longitudinally behind a front face (2) of the support structure, the grooves (3) having a continuous sectional profile and each groove opening in the front face through a channel (4);

a storage shelf (6) being formed on a back side (10) thereof with at least three tongues (7), the tongues being integrally formed with the shelf and adjoining the back side through a neck portion (8), at least one of said tongues (7) having a through hole for a bolt (9) that engages an inner wall of one of said grooves for securing the shelf in an operative, load bearing position;

the tongues (7) having a planar shape that is adapted to the sectional profile of the grooves (3), and the length and width of the neck portions (8) are adapted to the sectional length and width of the groove channels (4), respectively, whereby the tongues are received in the grooves while the neck portions occupy the channels;

the neck portions (8) being curved so that the tongues project upwards from the shelf top surface at a slanting angle, whereby the tongues (7) are permitted a sliding displacement in the grooves as the tongues are pivoted for a horizontal orientation, but frictionally arrested in the grooves (3) when the shelf is pivoted to bring the tongues to a tilted orientation in the operative position of the shelf, and the back side (10) of the shelf providing a load bearing contact against the front face (2) of the vertical support when the shelf is pivoted to the operative position.

2. The storage system of claim 1, wherein the grooves (3) are circular in section and the tongues (7) have a circular planar shape.

3. The storage system of claim 1, wherein the vertical support (1) is a self supported, hollow pentagonal column with storage shelves directly supported to extend radially from all sides of the column.

4. The storage system of claim 1, wherein the back side (10) is formed to have a rectangular orientation relative to the top plane of the shelf in horizontal, operative position, and an acute, angular orientation relative to the top plane of a shelf in slanting, operative position.

5. The storage system of claim 1, wherein the vertical support is rotatably mounted on a central, upright axis (14).

6. The storage system of claim 1, wherein a horizontal slot (11) reaches from the front face (2) into the grooves (3) for lateral insertion of the tongues (7) to be received in the grooves.

7. The storage system of claim 1, wherein the shelf (6) is made of hard metal, and the vertical support (1) is made of softer metal.

8. The storage system of claim 3, wherein the vertical support is rotatably mounted on a central, upright axis (14).

9. The storage system of claim 2, wherein a horizontal slot (11) reaches from the front face (2) into the grooves (3) for lateral insertion of the tongues (7) to be received in the grooves.

* * * * *